US005660575A

United States Patent [19]

Chuang

[11] Patent Number: 5,660,575

[45] Date of Patent: Aug. 26, 1997

[54] TOYS CAPABLE OF BEING ANIMATED BY DEPRESSING

[76] Inventor: Chuan-Tien Chuang, No. 40, Lane 174, Da-Shing Street, Tainan, Taiwan

[21] Appl. No.: 603,077

[22] Filed: Feb. 20, 1996

[51] Int. Cl.[6] ..... A63H 17/28; A63H 29/00

[52] U.S. Cl. ..... 446/409; 446/438

[58] Field of Search ..... 446/409, 457, 446/464, 486, 438, 439, 484, 485

[56] References Cited

U.S. PATENT DOCUMENTS 2,012,343 8/1935 Goriup ..... 446/457

3,919,804 11/1975 Nakata ..... 446/464

4,608,027 8/1986 Klamer et al. ..... 446/457

5,352,147 10/1994 Nagel et al. ..... 446/409

*Primary Examiner*—Mickey Yu

*Attorney, Agent, or Firm*—Bacon & Thomas

[57] ABSTRACT

A toy vehicle operated by depressing a body downwardly with respect to a captured case containing a rack and gear assembly so that upon release of the body, the rack actuates the gear assembly to rotate a set of wheels. Visual and sonic effects may be provided for actuation during depressing of the body.

1 Claim, 5 Drawing Sheets

TOYS CAPABLE OF BEING ANIMATED BY DEPRESSING

BACKGROUND OF THE INVENTION

1. Field of the Invention

The present invention is to provide a toy capable of being animated by depressing, in particular, a toy that can be played by depressing to run with sounding and flashing and of which the mechanism can be adapted to various toy vehicles, toy airplanes, toy ships, toy animals, toy robots and so on.

2. Description of the Prior Art

Moving toys are generally driven by mechanical or electrical energy sources. Among a variety of mechanical means, springs are often used due to convenience and low costs. However, problems occur that springs often fail to function due to fracture or fatigue in elasticity after a certain service time. Hence it is desirable to have a novel construction in which the foregoing defects can be avoided.

SUMMARY OF THE INVENTION

The primary object of the invention is to provide a toy that can be animated by depressing and that has a new and simple operating mechanism that children can play with in an easy way. The inventive toy has all parts arranged in such neat and simple manner that they can be maintained in an optimum condition. Also, the underlying concept of the invention can be adapted to toys of a variety of forms.

According to the invention, the mobile toy has a sounding and flash feature by incorporating an electrical triggering circuit and a proper arrangement of mechanical parts and electrical switches. Therefore, the mechanism according to the invention can promote the uniqueness of products and thus makes them gain an edge over opponents in the market. This is another object of the invention.

In order to accomplish the above objects, the invention provides a toy comprising an upper case half, a lower case half, a base, a rack, a spring, a gear train set, sounding and flash means, and wheels. The gear train set consists of a box and a gear train composed of a plurality of gears engaged one after another. The gear train set is disposed inside the base, with two wheel axles extending out of the base from the box. The base is further housed inside the lower case half and then two wheels are attached to the wheel axles from the outside of the case half. The box has an insertion opening provided on the top thereof for receiving the rack and the spring.

The rack is a hollow column with a single downwardly facing opening, which is longitudinally provided with a plurality of gear teeth on one side surface and of which the top extends to and engages with the upper case half. A spring that is slightly longer than the rack is disposed inside the rack opening, with one end of the spring extending into the insertion opening of the box. The two case halves are fastened together by screws. When the spring urges the rack to move vertically, the gear train rotates the wheels and thus the toy starts to move. In the arrangement the sounding and flash means is a single triggering circuit with two contact points of a contact switch thereof respectively disposed on the upper case half and the base. When two contact points come to touch one another, the means produces sounds and twinkling light.

As described above, the toy of the invention has a new mechanism with fun and novel driving means. The applied principles contained in the toy is simple and practicable. All parts can be arranged in a neat and efficient manner and thus they can be maintained in an optimum state. Also, it should be understood that the invention my be embodied in other specific forms or toys, not limited to the illustrative embodiment disclosed in the following description.

The detailed structure, applied principles, features and advantages will become apparent from the following description of the preferred embodiment of the invention as illustrated in the accompanying drawings.

BRIEF DESCRIPTION OF THE ACCOMPANYING DRAWINGS

DETAILED DESCRIPTION OF PREFERRED EMBODIMENTS

Figure 1:
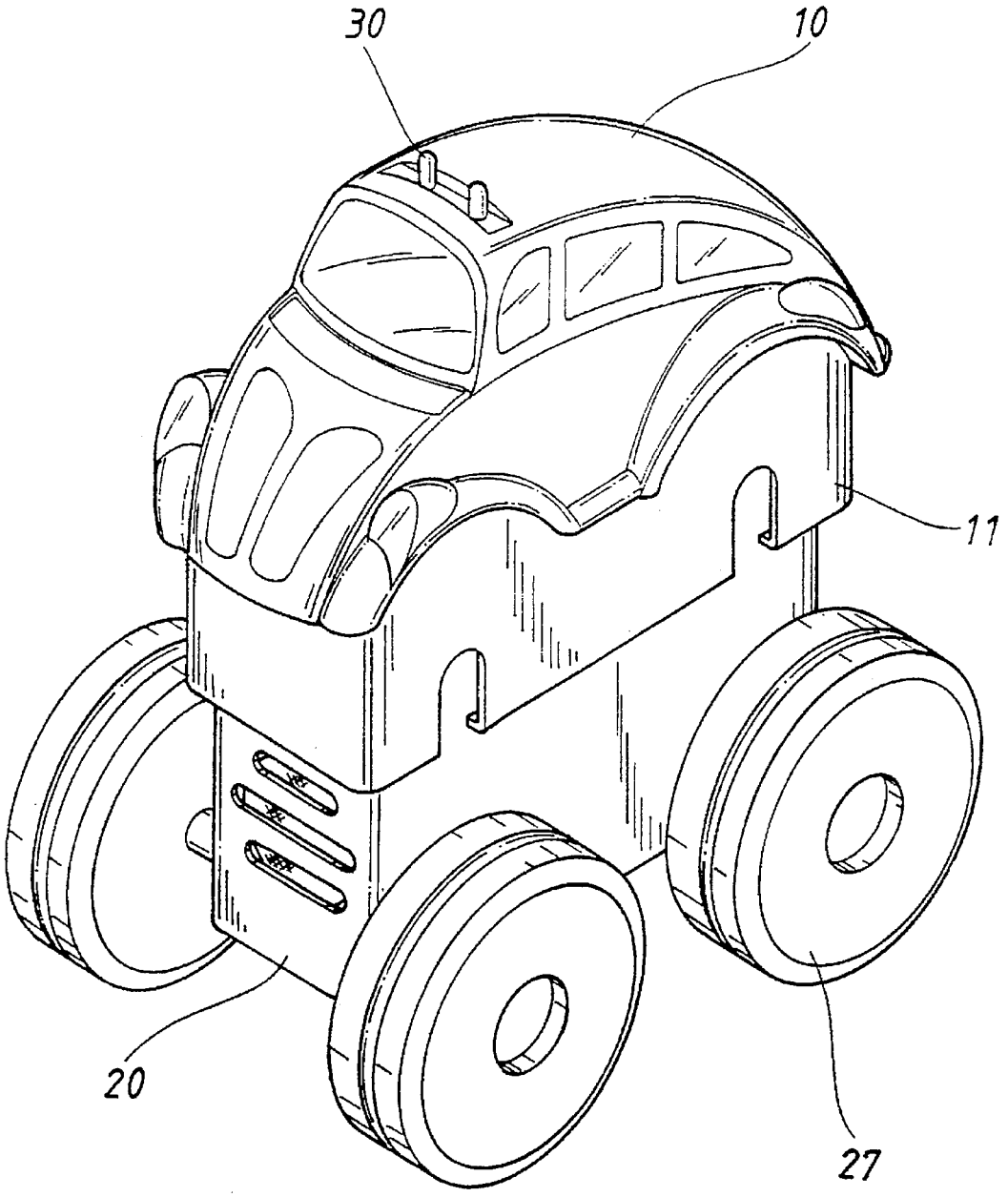
FIG. 1 is a perspective view of the outer appearance of a toy car according to the invention.
Figure 2:
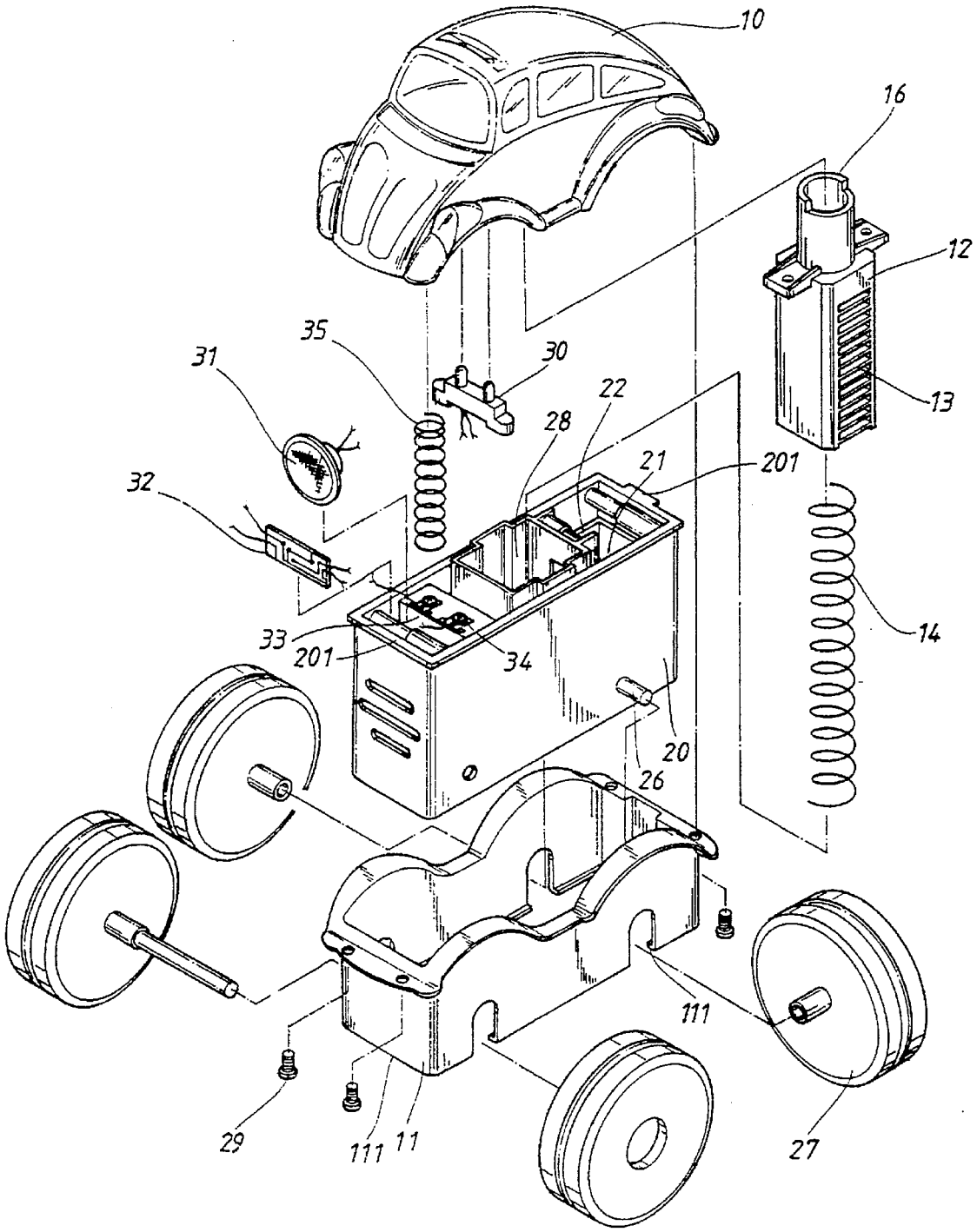
FIG. 2 is an exploded view of the toy car of FIG. 1.

Referring to FIGS. 1 and 2, the toy car of the invention comprises an upper case half (10), a lower case half (11), a base (20), a rack (12), a spring (14), a gear train set (21), a sounding and flash device, and wheels. The gear train set (21) consists of a box (22) and a gear train (23) composed of a plurality of gears linked one after another as show in FIG. 3. The gear train set (23) is disposed inside the base (20), with two wheel axles (26) extending out of the base (20) from the box (22). The base (20) is further housed inside the lower case half (11) and then two wheels (27) are attached to the wheel axles (26) from the outside of the lower case half (11). The box (22) has an insertion opening (28) provided on the top thereof for receiving the rack (12) and the spring (14).

Figure 3:
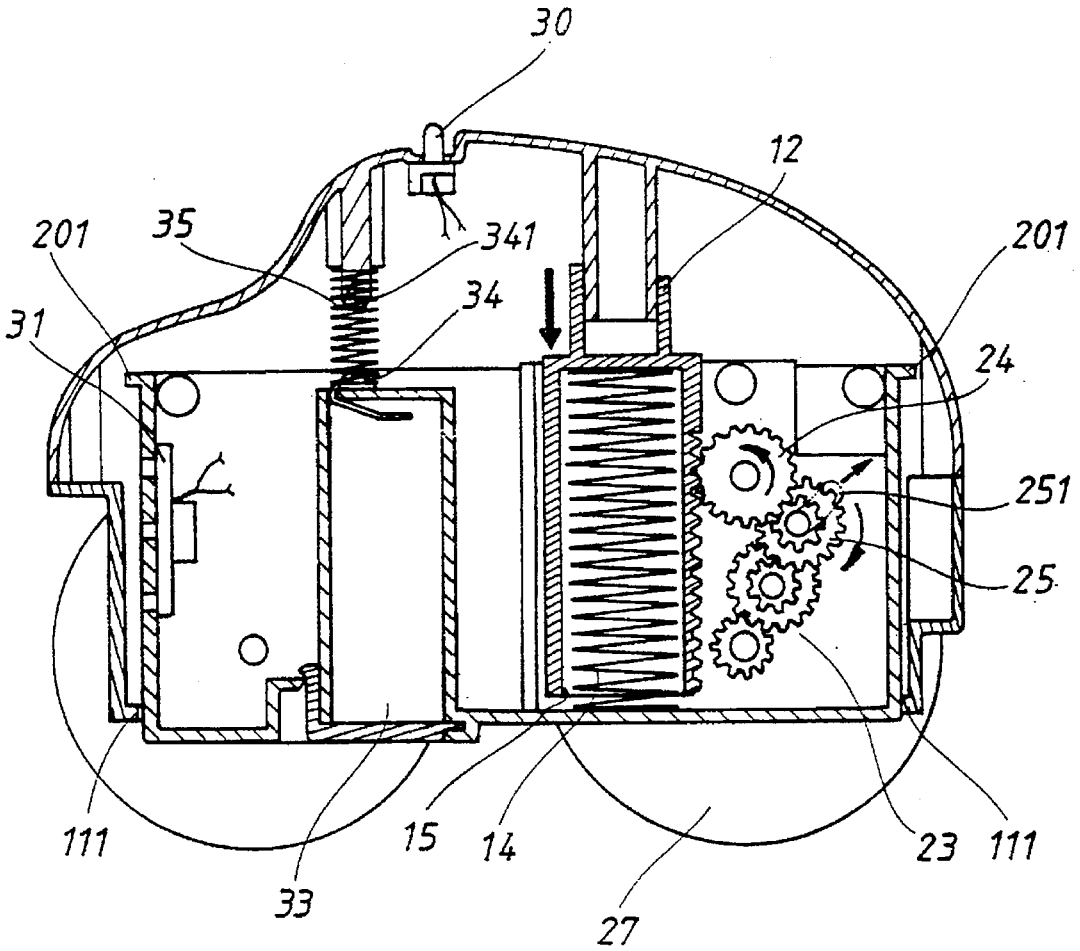
FIGS. 3 and 3A are cross sectional views showing the movement of the mechanism caused in the toy car of FIG. 1 as the toy car is animated by depressing.
Figure 3A:
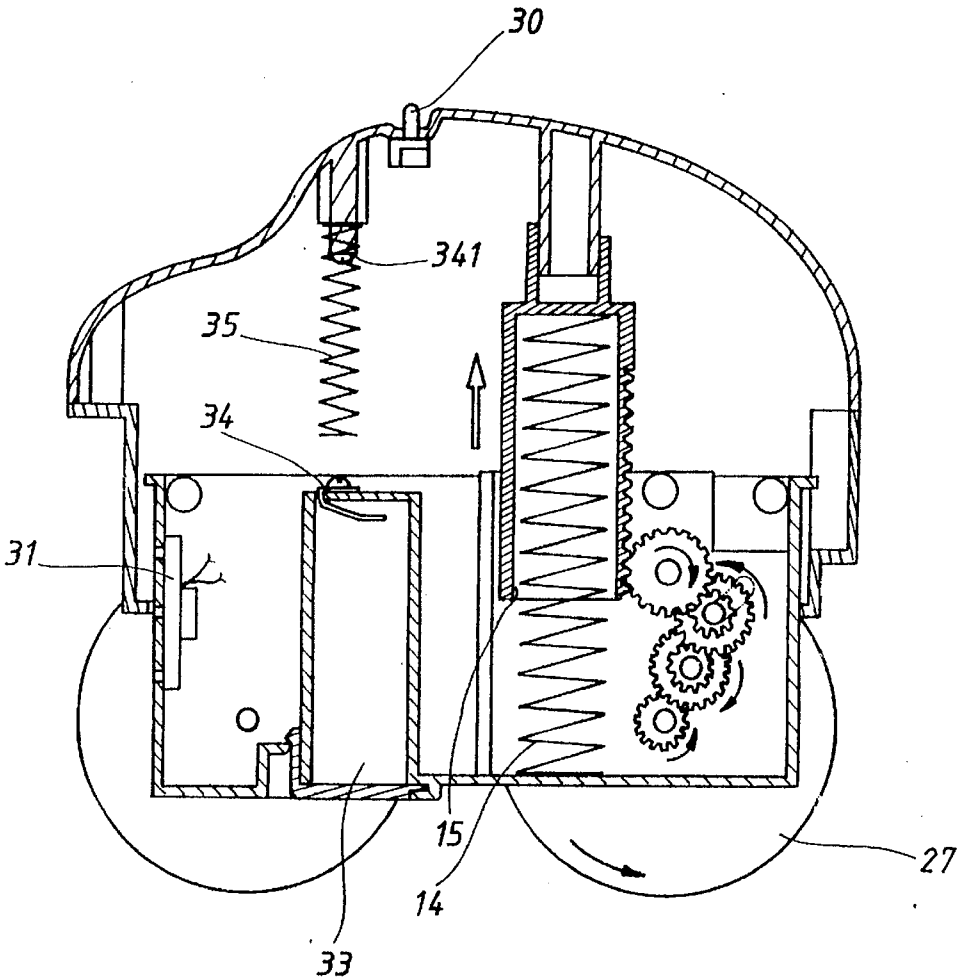

As can be seen from FIGS. 2, 3, and 3A, the rack (12) is a hollow column with a single downwardly facing opening (15), which is longitudinally provided with a plurality of gear teeth (13) on one side surface and of which the top (16) extends to and engages with the upper case half (10). A spring (14) that is slightly longer than the rack is disposed inside the opening (15), with one end of the spring (14) extending into the insertion opening (28) of the box (22). Then two case halves (10) and (11) are fastened together by screws (29). The toy car is operated as follows. When the upper case half (10) is pressed down, the rack (12) extends into the insertion opening (28) and compresses the spring (14). At the same time, a first gear (24) and a second gear (25) of the gear train (23) are driven to rotate. However, the holes (251) formed on the walls of the box (22) to support the shaft of the second gear (25) are so elongated and curved in shape that when the gear (25) is driven to rotate in a clockwise direction the shaft of the gear (25) moves to the other end of the elongated hole (251) and the gear (25) idly rotates. As a result, the wheels (27) can not be driven. When the force acting on the upper case half (10) is removed, the upper case half (10) together with the lower case half (11) is urged upwardly by the spring (14). Hence, the rack (12) moves to drive the gear train (23), which in turn rotates the wheels (27). When the upper case half, with the lower case half together, rises to the highest point of the up travel, a flange (111) formed on the lower case half (11) abuts against a flange (201) formed on the base (20) so that the case halves will not jump apart from the base.

Figure 4:
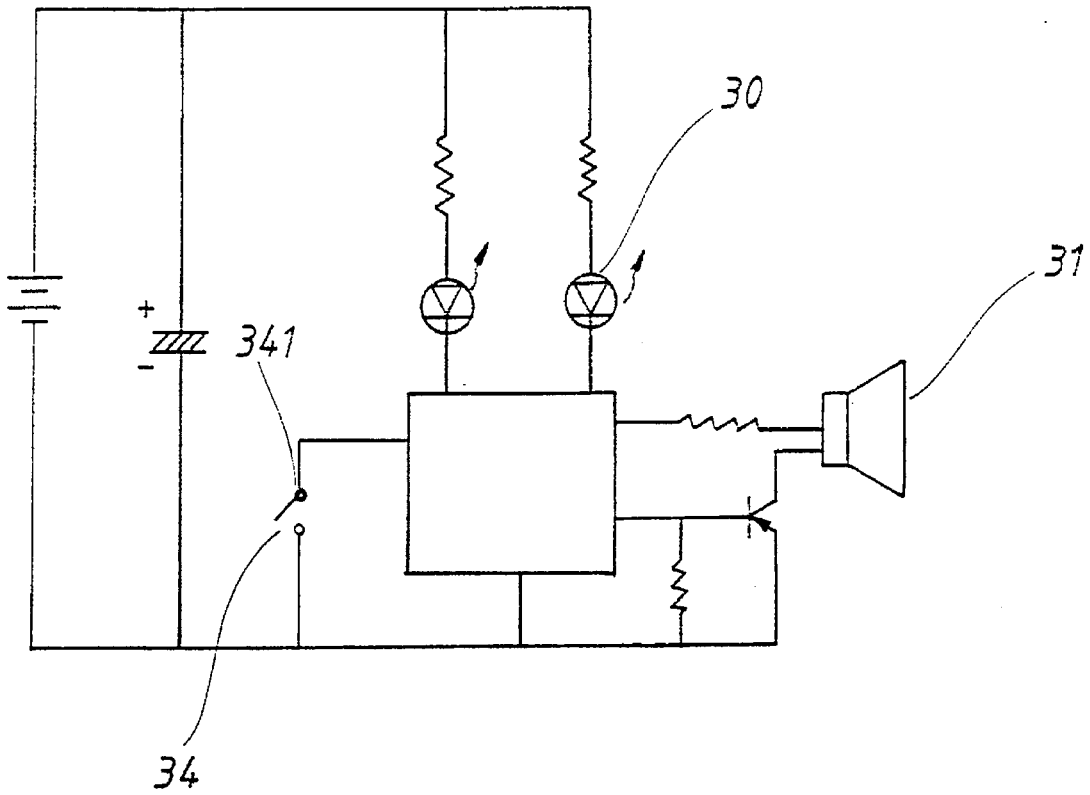
FIG. 4 is an electrical circuit schematic diagram of the toy car of the invention.

Referring now to FIGS. 2 and 4, the toy car of the invention is provided with a triggering circuit for the sounding and flash means thereof. A lighting device (30) is disposed on the upper case half (10) at an appropriate position and a speaker (31) is arranged on the base (20). The base is further provided with a circuit board (32) and a battery compartment (33). The contact points (341) and (34) of a contact switch of the sounding and flash means are respectively provided on the upper case half (10) and the base (20). When the upper case half (10) is pressed down to cause the two contact points to touch one another, an electrical signal is sent out to the circuit board (32). Then, the lighting device (30) and the speaker (31) start to function and produce light and sounds in a consecutive way until the upper case half (10) being pressed down is released, the toy car starts to run, the upper case half (10) comes back to its starting position, and two contact points (34) and (341) separate from one another. Also, a spring (35) can be added as shown in the drawings to prolong the time of lighting and sounding.

As described above, the toy car of the invention has a simple and reliable construction in which all parts of the toy car have obtained an optimum arrangement. Although the present invention has been described by means of a preferred embodiment of a toy car, it should be understood that the underlying concept of the invention is equivalently applicable to various toys of other forms. The invention has practical value in the design of toys. It is a new and useful invention without doubt.

What is claimed is:

1. A toy comprising:

a) a body including an upper case half and a lower case half;

b) a base captured within the body and moveable inwardly and outwardly relative to the lower case half;

c) a rack and a gear assembly disposed within the base, the rack being secured to the upper case half and moveable inwardly of the base for rotating the gear assembly in a first direction and outwardly of the base for rotating the gear assembly in a second direction during movement of the base relative to the lower case half;

d) axle means driven by the gear assembly when the gear assembly is rotated in the second direction, and wheel means mounted on the axle means for rotation thereby during driving of the axle means;

e) a first spring means urging the rack towards the outward position for permitting a user to operate the toy by depressing and releasing the body relative to the base;

f) a single triggering circuit having a switch defined by two contact points, one contact point being carried by the upper case half and the other contact point being carried by the base, whereby the two contact points are caused to come into engagement and close the circuit when the body is depressed relative to the base;

g) a sounding means and a flashing means electrically connected in the triggering circuit for actuation upon closing of the circuit; and, h) a second spring means disposed between the two contact points for prolonging the closing of the circuit upon releasing of the body.

* * * * *